US009138037B2

(12) United States Patent
Crandall

(10) Patent No.: US 9,138,037 B2
(45) Date of Patent: Sep. 22, 2015

(54) DIVIDER SYSTEM FOR A CAMERA BAG

(71) Applicant: DAYMEN CANADA ACQUISITION ULC, Vancouver (CA)

(72) Inventor: Kevin Duane Crandall, Santa Rosa, CA (US)

(73) Assignee: Daymen Canada Acquisition ULC, Vancouver (CA)

( * ) Notice: Subject to any disclaimer, the term of this patent is extended or adjusted under 35 U.S.C. 154(b) by 0 days.

(21) Appl. No.: 14/010,456

(22) Filed: Aug. 26, 2013

(65) Prior Publication Data

US 2015/0053580 A1 Feb. 26, 2015

(51) Int. Cl.

| | |
|---|---|
| ***A45C 11/38*** | (2006.01) |
| ***B65D 25/04*** | (2006.01) |
| ***A45C 3/00*** | (2006.01) |
| ***A45C 13/02*** | (2006.01) |

(52) U.S. Cl.

CPC . *A45C 11/38* (2013.01); *A45C 3/00* (2013.01); *A45C 13/02* (2013.01); *B65D 25/04* (2013.01); *A45C 2013/026* (2013.01)

(58) Field of Classification Search

CPC ..... A45C 13/02; A45C 11/38; B65D 25/04
USPC ..... 206/316.1, 316.2, 561; 220/523; 190/110; 150/113
See application file for complete search history.

(56) References Cited

U.S. PATENT DOCUMENTS

| | | | | |
|---|---|---|---|---|
| 1,490,001 | A * | 4/1924 | Gaynor | 190/110 |
| 2,548,781 | A * | 4/1951 | Goodman, Jr. | 292/129 |
| 3,112,017 | A * | 11/1963 | Lifton | 190/11 |
| 4,545,414 | A * | 10/1985 | Baum | 224/580 |
| 4,842,032 | A * | 6/1989 | Mastronardo | 206/308.1 |
| 7,428,975 | B2 * | 9/2008 | Bradford | 220/529 |
| 8,281,950 | B2 * | 10/2012 | Potts et al. | 220/531 |
| 2002/0144916 | A1 * | 10/2002 | Cheng | 206/315.1 |
| 2008/0142558 | A1 * | 6/2008 | Dexter | 224/275 |
| 2010/0071814 | A1 * | 3/2010 | Crandall | 150/113 |
| 2012/0321226 | A1 | 12/2012 | Hansen | |

OTHER PUBLICATIONS

European Search Report, EP Application No. 14 181 870.8, dated Jul. 10, 2015.

* cited by examiner

*Primary Examiner* — Sue A Weaver
(74) *Attorney, Agent, or Firm* — Medler Ferro PLLC

(57) ABSTRACT

A divider for a bag includes a generally planar panel, a first attachment mechanism coupled to the panel offset from a first edge of the panel, and a second attachment mechanism offset from a second edge of the panel. The first and second attachment mechanisms each includes a first configuration wherein it extends from the respective first and second edges towards the other of the first and second attachment mechanism, and a second configuration wherein the respective attachment mechanism is rotated to be generally perpendicular to the panel and configured to attach to opposing first and second walls of a bag.

7 Claims, 9 Drawing Sheets

DIVIDER SYSTEM FOR A CAMERA BAG

FIELD OF THE INVENTION

The invention is related to divider system for a camera bag and a method of using a divider system to adjust the size of compartments in a camera bag.

BACKGROUND OF THE INVENTION

Dividers are well-known for all types of bags in order to divide an interior compartment into several smaller compartments. Dividers are particularly used for camera bags so that accessories and other items may be stored together in a bag, but are protected from damage of hitting against each other by the dividers. For example, camera bodies, camera lenses, batteries, memory cards, and other items may be stored in camera bags and separated by dividers. In some instances, the dividers may be movable and removable to adjust the size and configuration of the compartments within the interior of the bag.

For example, FIGS. 1-2 show a camera bag 100 with an interior 102 separated into different compartments by dividers 104. As can be seen in FIG. 2, and in more detail in FIG. 3, dividers 104 typically include a padded center or divider portion 114 and first and second attachment mechanisms or wings 106*a*, 106*b* attached to opposite sides of divider portion 114. Divider portion 114 typically includes a foam interior covered by a material such as nylon. Wings 106*a*, 106*b* typically include a hook or loop material 116*a*, 116*b* (typically hook material) to removably attach divider 104 to a corresponding loop or hook material 108 or 110 (typically loop material) attached to walls of the camera bag 100.

FIG. 2 shows two exemplary ways that the loop material 108 or 110 may be disposed within a bag for a divider 104 to attached thereto. Loop material 110 is in the form of a strip. Several strips may be disposed at different locations within the bag for the hook material 106*a*, 106*b* of divider 104 to attached thereto. However, the use of such strips limits the possible configurations of the interior compartments formed by dividers 104 because the dividers can only be placed at the location of the strips. Loop material 108, as shown in FIG. 2, is a larger rectangle of material that covers a large area of a wall 112 of bag 100. This larger patch of loop material 108 allows a divider 104 to be placed anywhere along wall 112 and a corresponding opposite wall 113 with a corresponding patch of loop material (not shown). This type of arrangement, while permitting flexibility in the location of dividers 104, and thereby flexibility in the size of the compartments created by dividers 104, may be frustrating to users because the hook material 116*a*, 116*b* of wings 106*a*, 106*b* may attach to loop material 108 at undesirable locations. Thus, it is difficult to adjust the location of dividers 104 in small increments and difficult to locate the dividers 104 at a precise desired location. Further, in some instances it is difficult to completely or fully insert dividers 104 into interior 102 because the hook material 116*a*, 11*b* of wings 106*a*, 106*b* catches on the loop material 108 or 110 prior to full insertion. Accordingly, there is a need for a divider system that permits flexibility in location of the divider while also allowing precise placement, full insertion, and attachment of the divider.

BRIEF SUMMARY OF THE INVENTION

Embodiments hereof are directed to a divider for separating a compartment of a bag. The divider includes a generally planar panel including a first edge, a second edge, a third edge, and a fourth edge. A first attachment mechanism is coupled to the panel adjacent the first edge along a first line generally parallel to and spaced a distance from the first edge. A second attachment mechanism is coupled to the panel adjacent the second edge along a second line generally parallel to and spaced a distance from the second edge. The first attachment mechanism includes a first configuration wherein it extends from the first line away from the first edge and generally parallel to the planar panel and a second configuration wherein the first attachment mechanism extends from the first line generally perpendicular to the planar panel such that the first attachment mechanism is configured to attach to a first wall of the bag. The second attachment mechanism includes a first configuration wherein the second attachment mechanism extends from the second line away from the second edge and generally parallel to the planar panel and a second configuration wherein the second attachment mechanism extend from the second line generally perpendicular to the planar panel such that the second attachment mechanism is configured to attach to a second wall of the bag. In an embodiment, the first attachment mechanism includes a flap of a hook or loop material such that in the first configuration the hook or loop material faces away from a first surface of the panel and in the second configuration of the first attachment mechanism the flap is rotated around the first line such that hook or loop material faces outwardly from a center of the panel and is configured to attach to a corresponding loop or hook material of the first wall of the bag. Similarly, in an embodiment, the second attachment mechanism includes a flap of a hook or loop material such that in the first configuration of the second attachment mechanism the hook or loop material faces away from a first surface of the panel and in the second configuration of the second attachment mechanism the flap is rotated around the second line such that hook or loop material faces outwardly from a center of the panel and is configured to attach to a corresponding loop or hook material of the first wall of the bag.

Embodiments hereof are also directed to a bag including an interior compartment defined by at least a first wall, a second wall, a third wall, and a fourth wall, wherein at least the first wall and the second wall include a patch of loop or hook material. The bag further includes a divider panel included a first edge, a second edge, a third edge, and a fourth edge, wherein the first and second edges are generally parallel to each other and the third and fourth edges are generally parallel to each other. A first attachment mechanism includes a hook or loop material and is coupled to the divider panel offset a distance from the first edge of the panel. The first attachment mechanism includes a first configuration wherein the first attachment mechanism extends away from the first edge and is generally parallel to the divider panel and a second configuration wherein the first attachment mechanism extends generally perpendicular to the divider panel such that the hook or loop material engages the corresponding loop or hook of the first wall defining the interior compartment. A second attachment mechanism includes a hook or loop material and is coupled to the divider panel offset a distance from the second edge of the panel. The second attachment mechanism includes a first configuration wherein the second attachment mechanism extends away from the second edge and is generally parallel to the divider panel and a second configuration wherein the second attachment mechanism extends generally perpendicular to the divider panel such that the hook or loop material of the second attachment mechanism engages the corresponding loop or hook of the second wall defining the interior compartment.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Although the descriptions of embodiments hereof are in the context of a divider for a camera bag, the invention may also be used in any other applications where it is deemed useful, such as other types of bags. Furthermore, there is no intention to be bound by any expressed or implied theory presented in the preceding technical field, background, brief summary or the following detailed description.

Figure 4:
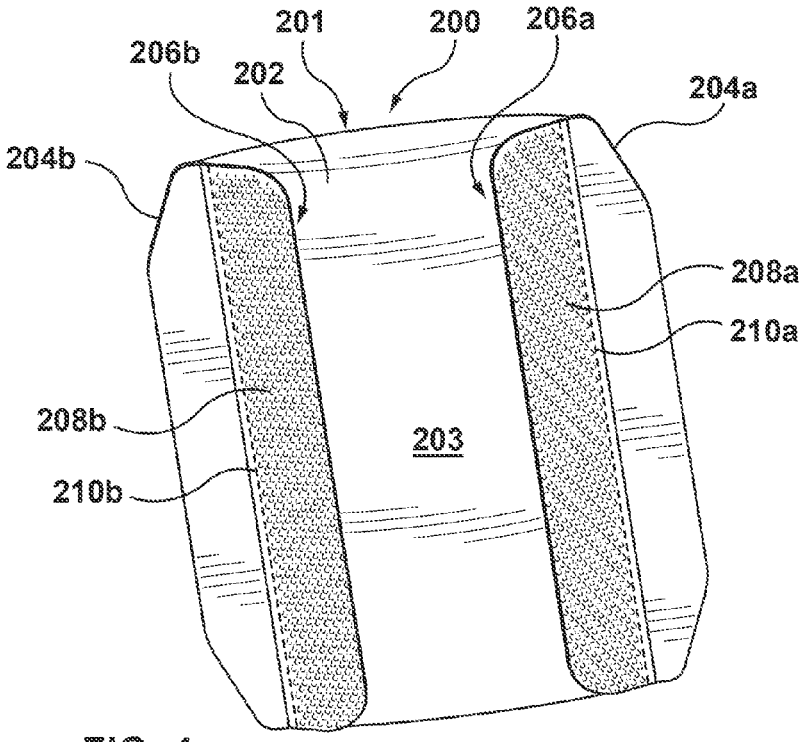
FIG. 4 is a schematic illustration of an embodiment of a divider of the present application.
Figure 5:
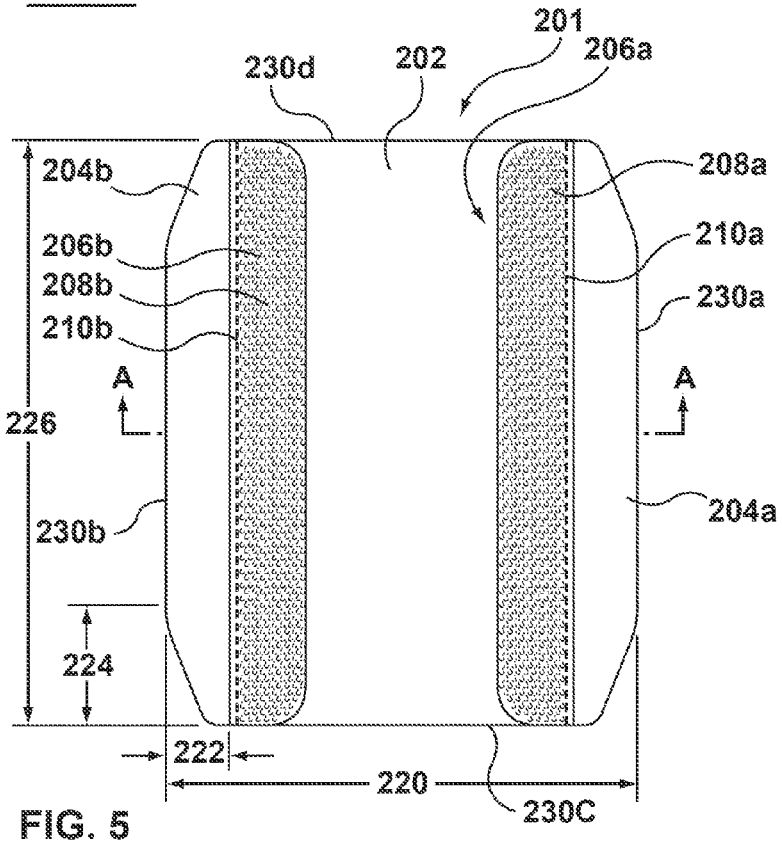
FIG. 5 is a front view of the divider of FIG. 4.

Referring to FIGS. 4-5, an embodiment of a divider 200 hereof is shown. Divider 200 includes a generally planar panel 201 with edges 230*a*, 230*b*, 230*c*, and 230*d*. As shown in FIGS. 4-5, planar panel 201 is generally rectangular in shape, with the corners of the rectangle rounded or cut-away, as shown in FIG. 5. However, those skilled in the art would recognize that other shapes may be utilized depending on the application. Panel 201 includes a center or divider portion 202 which is configured to divide the interior of a bag into separate compartments and locator portions or wings 204*a*, 204*b* coupled to opposite sides of divider portion 202. Attachment mechanisms or flaps 206*a*, 206*b*, described in more detail below, are each coupled to panel 201 set-back a distance from edges 230*a*, 230*b* of panel 201, respectively. As can be seen in FIGS. 4-5, divider portion 202 is generally planar and locator portions 204*a*, 204*b* extend away from divider portion 202 generally along the same plane as divider portion 202.

Divider portion 202 may be formed from a soft protective material such as nylon or polyester and may include a thin padding such as cross-linked foam within the soft protective material, as known to those skilled in the art. Locator portions 204*a*, 204*b* may be formed of the same material as divider portion 202 or a different material. In one embodiment, shown in FIG. 6, divider portion 202 and locator portions 204*a*, 204*b* are all formed from a covering material 214 with a padding material 216 disposed therein. In this embodiment, divider portion 202 and locator portions 204*a*, 204*b* are formed unitarily. Stitching 212*a* through opposite sides of covering material 214 and padding 216 compresses padding 216 between opposite sides of covering material 214, which are gathered towards each other, to divide divider portion 202 from locator portion 204*a*. Similarly, stitching 212*b* through opposite sides of covering material 214 and padding 216 compresses padding 216 between opposite sides of covering material 214, which are gathered towards each other, to divide divider portion 202 from locator portion 204*b*. In another embodiment (not shown), stitching 212*a*, 212*b* may be eliminated such that locator portions 204*a*, 204*b* are merely extensions of divider portion 202. In such an embodiment, stitching 210*a*, 210*b* for attachment mechanisms 206*a*, 206*b* may be used as a separation between divider portion 202 and locator portions 204*a*, 204*b*. In other words, stitching 210*a*, 210*b* may also serve as stitching 212*a*, 212*b* described herein. In another embodiment, shown in FIG. 6A, panel 201 is unitary such that divider portion 202 extends all the way to edges 230*a*, 203*b*. Further, stitching 210*a*, 210*b* does not extend all the way through padding 216 such that panel 201 is not divided into a divider portion and locator portions. Such an embodiment may be utilized, for example and not by way of limitation, with padding 216 that is stiffer when a relatively stiffer divider is desired. However, those skilled in the art would recognize that that such an embodiment can be used with the same padding as described for the embodiments of FIG. 6, described above, or FIGS. 7-8 described below.

Figure 7:
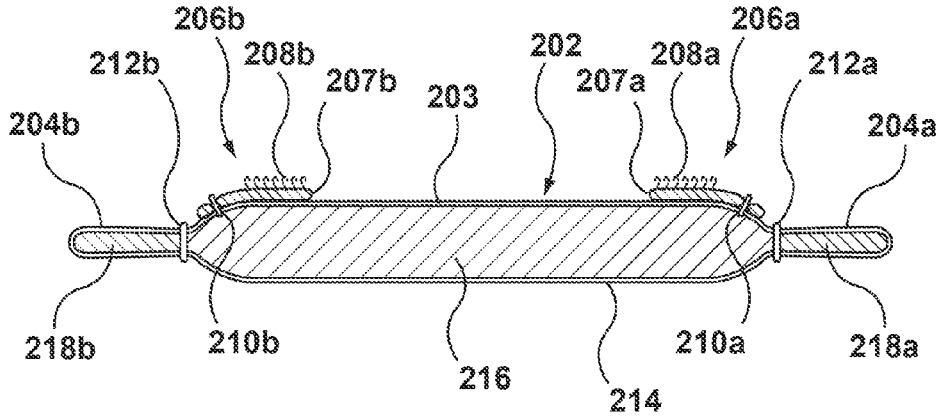

In another embodiment, shown in FIG. 7, a cover material 214 is common for divider portion 202 and locator portions 204*a*, 204*b*. However, padding 218*a*, 218*b* disposed within locator portions 204*a*, 204*b* is different from padding 216 disposed within locator portion 202. Stitching 212*a* through opposite sides of covering material 214 separates padding 216 from padding 218*a* and stitching 212*b* through opposite sides of covering material 214 separates padding 216 from padding 218*b*. This stitching 212*a*, 212*b* thereby separates divider portion 202 from locator portions 204*a*, 204*b*. In another embodiment, shown in FIG. 8, divider portion 202 and each of locator portions 204, 204*b* are separate components that are attached to each other. In particular, locator portion 204*a* formed from a covering material 215*a* and padding 218*a* is attached to one side of divider portion 202 via stitching 212*a* and locator portion 204*b* formed from a covering material 215*b* and padding 218*b* is attached to the opposite side of divider portion 202 via stitching 212*b*. As would be apparent to those skilled in the art, other attachment mechanisms, such as adhesive, heat bonding, clips, rivets, staples, hook and loop fasteners, or the like, may be used to couple locator portions 204*a*, 204*b* to divider portion 202.

Figure 6:
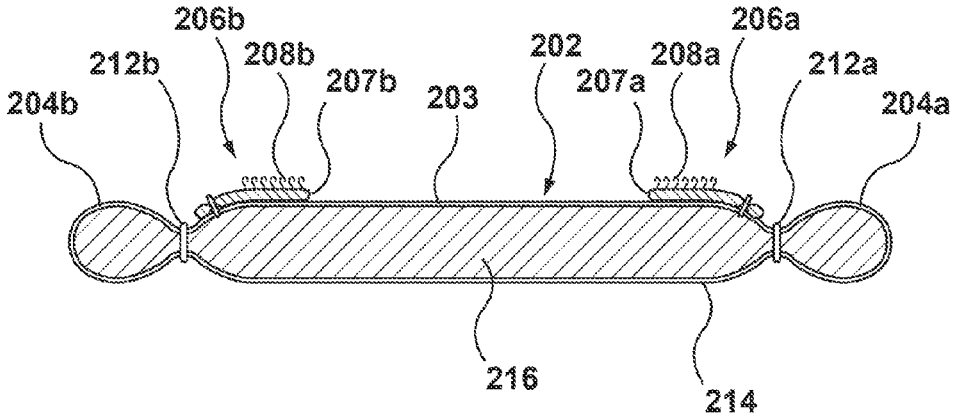
FIGS. 6-8 are exemplary embodiments of a cross-section taken along line A-A of FIG. 5.
Figure 8:
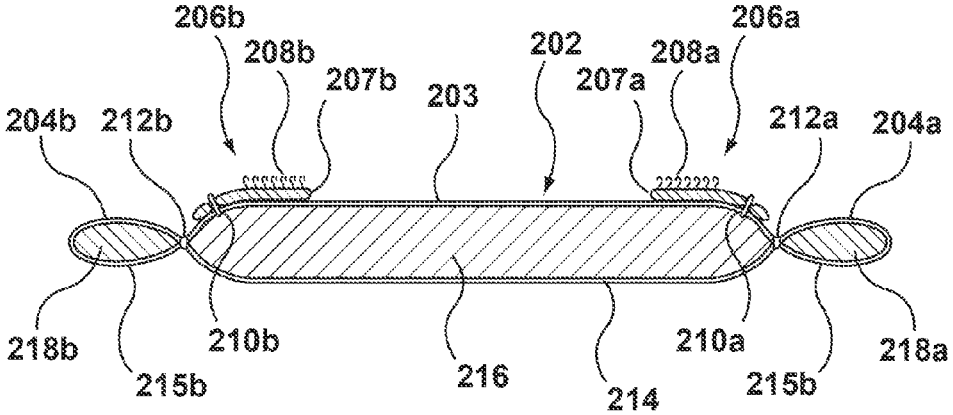
Figure 6A:
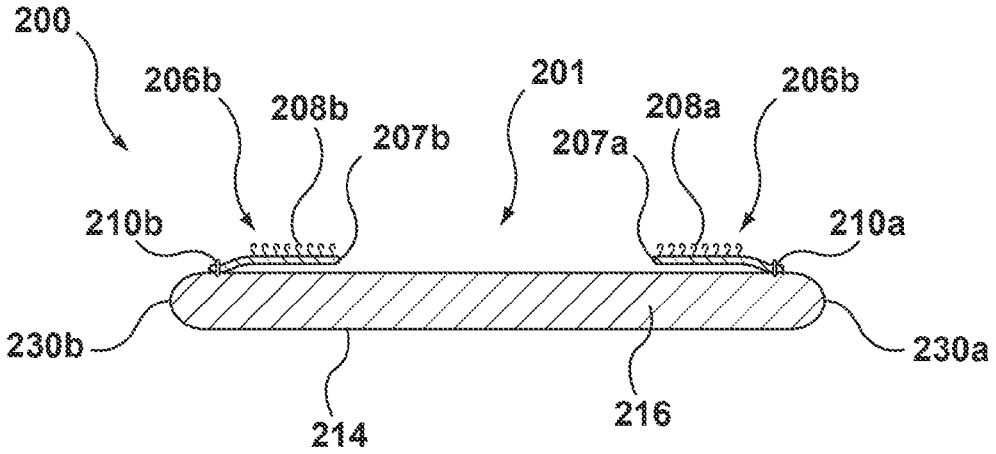
FIG. 6A is another exemplary embodiment of a cross-section taken along line A-A of FIG. 5.

Also shown in FIGS. 6-8, attachment mechanisms 206*a*, 206*b* are coupled to panel 201 using stitching 210*a*, 210*b*, respectively, and are initially oriented towards each other, as explained in more detail below. As shown in FIGS. 4-5, attachment mechanisms are attached to panel 201 generally where divider portion transitions to locator portions 202*a*, 202*b*. However, as would be understood by those skilled in the art, attachment mechanisms 206*a*, 206*b* may be attached to other portions of panel 201. For example, and not by way of limitation, attachment mechanisms 206*a*, 206*b* may be attached to locator portions 204*a*, 204*b*, respectively, but set back a distance from edges 230*a*, 230*b* of panel 201 towards divider portion 202. As would be further understood by those skill in the art, attachment devices other than stitching 210*a*, 210*b* may be used to couple attachment mechanisms 206*a*, 206*b* to panel 201 or locator portions 204*a*, 204*b*, such as adhesive, heat bonding, clips, rivets, staples, hook and loop fasteners, or the like. Attachment mechanisms 206, 206*b* may be formed from hook or loop material 208*a*, 208*b*, disposed on a backing material 207*a*, 207*b*, as shown in FIGS. 6-8. However, as would be understood by those skilled in the art, other configurations may be utilized, provided that hook or loop material 208*a*, 208*b* may be utilized in the manner described below with respect to FIGS. 9-11.

FIG. 5 shows a particular embodiment of a divider 200, with an overall width 220 of panel 201 and a length 226. In one particular embodiment width 220 may be approximately 10 cm and length 226 may be approximately 17.5 cm. In the embodiment shown in FIG. 5 locator portions 204*a*, 204*b* each have a width of approximately 1.5 cm. Further, each corner of divider 200 is angled for a height 224 of approximately 3 cm, as shown in FIG. 5. As would be understood by those skilled in the art, the dimensions noted above are only examples, and may be varied depending on the particular application for which divider 200 is to be used, personal design choice, and other factors.

Figure 11A:
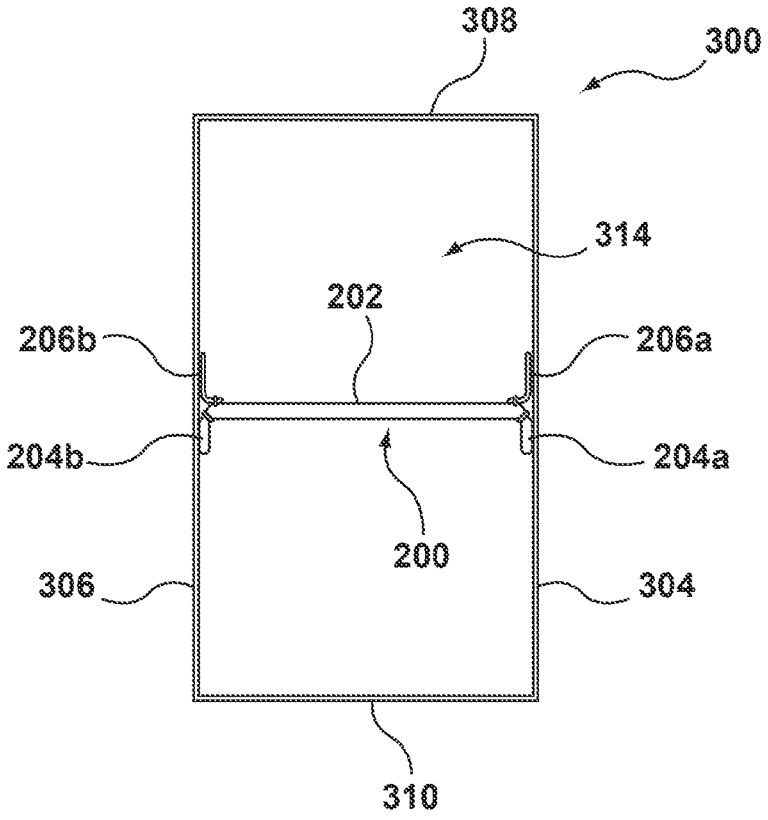
FIG. 11A is a schematic front view illustration of the divider disposed in a bag after the method of FIGS. 9-11.
Figure 11:
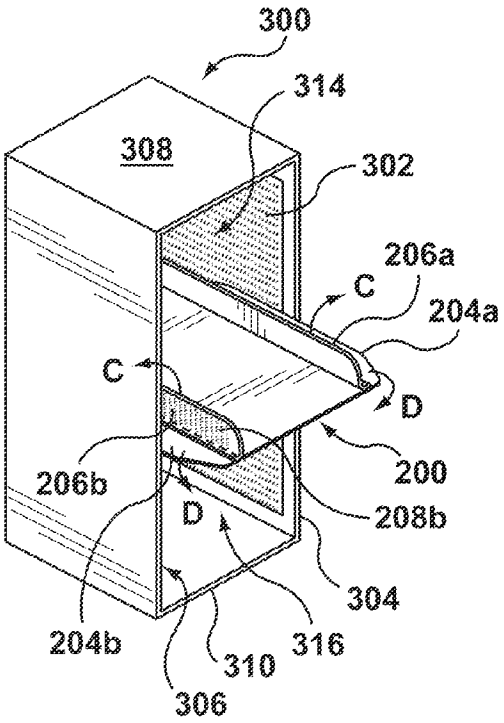
FIGS. 9-11 are schematic illustrations of an embodiment of a method for locating and attaching the divider of FIG. 4 in a bag.
Figure 10:
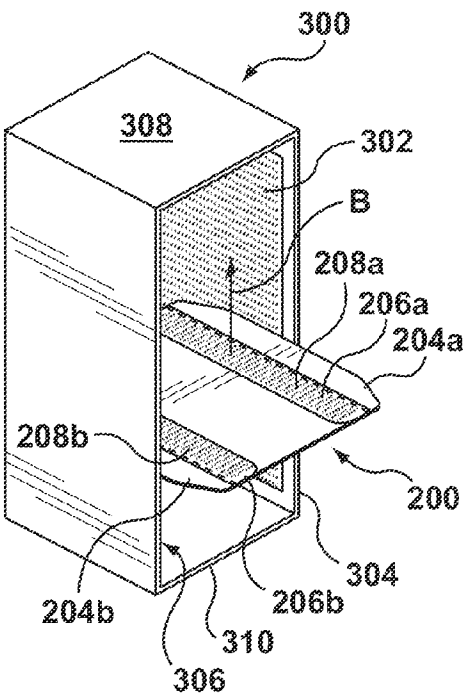
Figure 9:
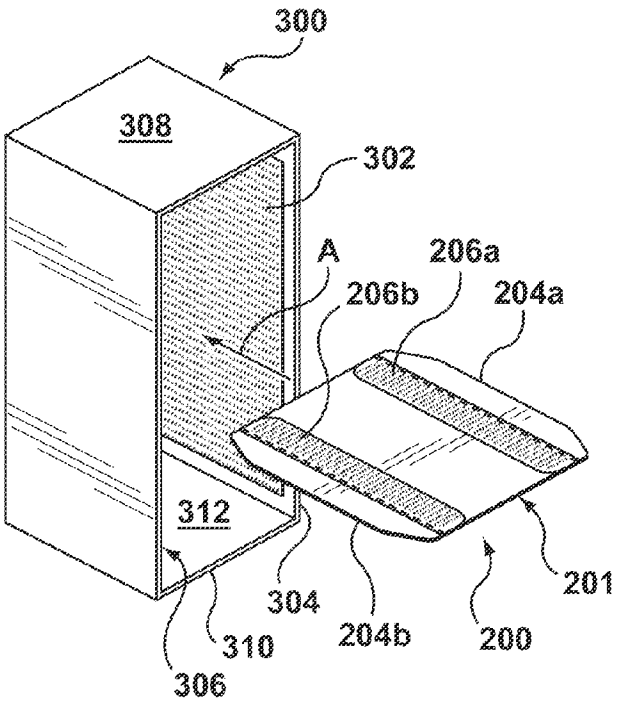

FIGS. 9-11 show a divider 200 in use with a schematic representation of a bag 300 or a portion thereof. In particular, bag 300 includes first and second panels 304, 306 disposed generally parallel to each other and third and fourth panels 308, 310 disposed generally parallel to each other and generally perpendicular to first and second panels 304, 306. Opposite edges of third panel 308 are coupled to a first edge of each of first and second panels 304, 306. Similarly opposite edges of fourth panel 310 are coupled to a second edge of each of first and second panel 346, 306. Panels 304, 306, 308, 310 define and interior compartment 312, as shown in FIG. 9. A back panel (not shown) may also be included with bag 300, as known to those skilled in the art. An interior surface of first wall 304 includes a large patch of loop material 302. Similarly, an interior surface of second wall 306 includes a large patch of loop material (not shown).

Figure 1:
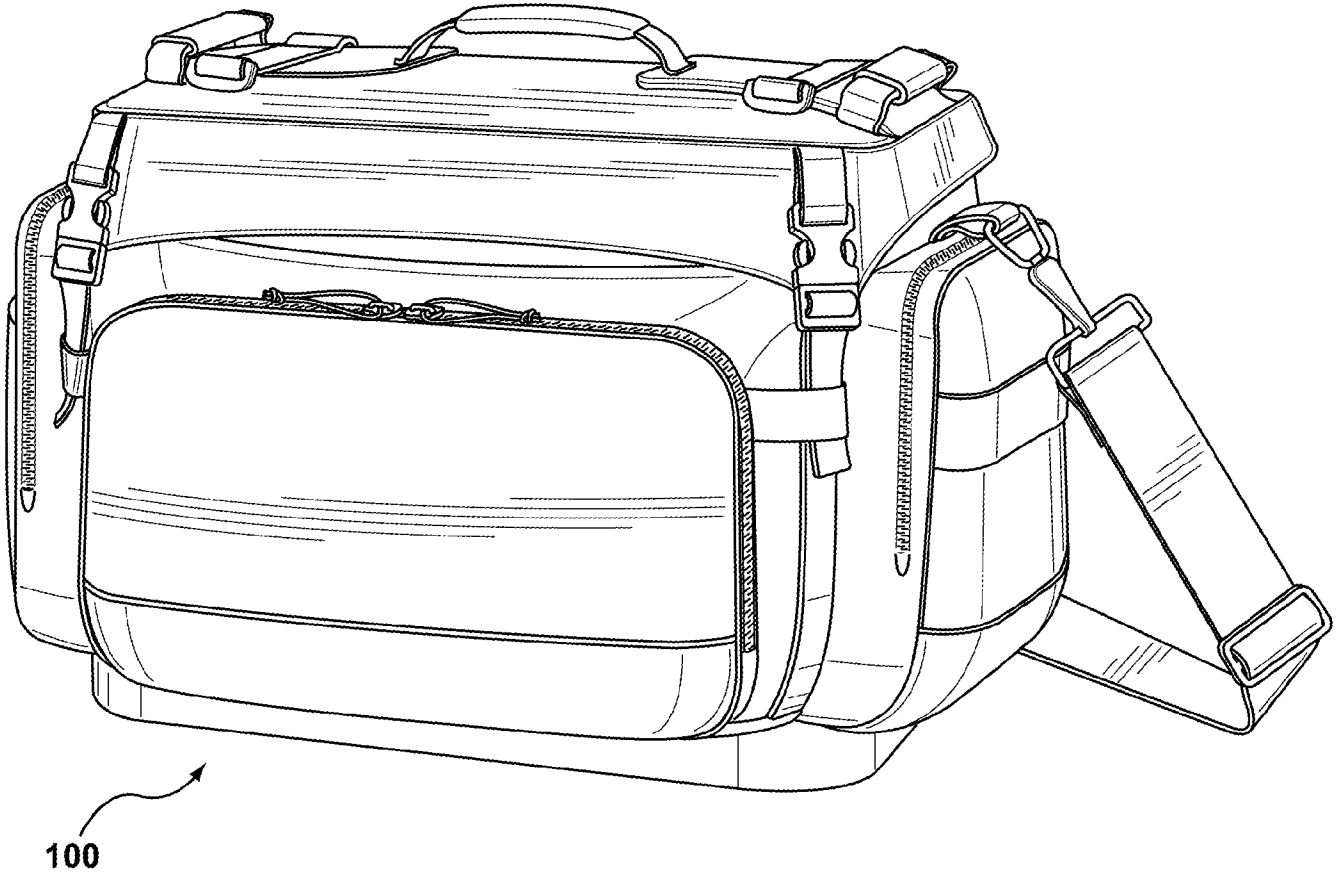
FIG. 1 (PRIOR ART)
FIG. 1 is perspective view of a known camera bag.
Figure 2:
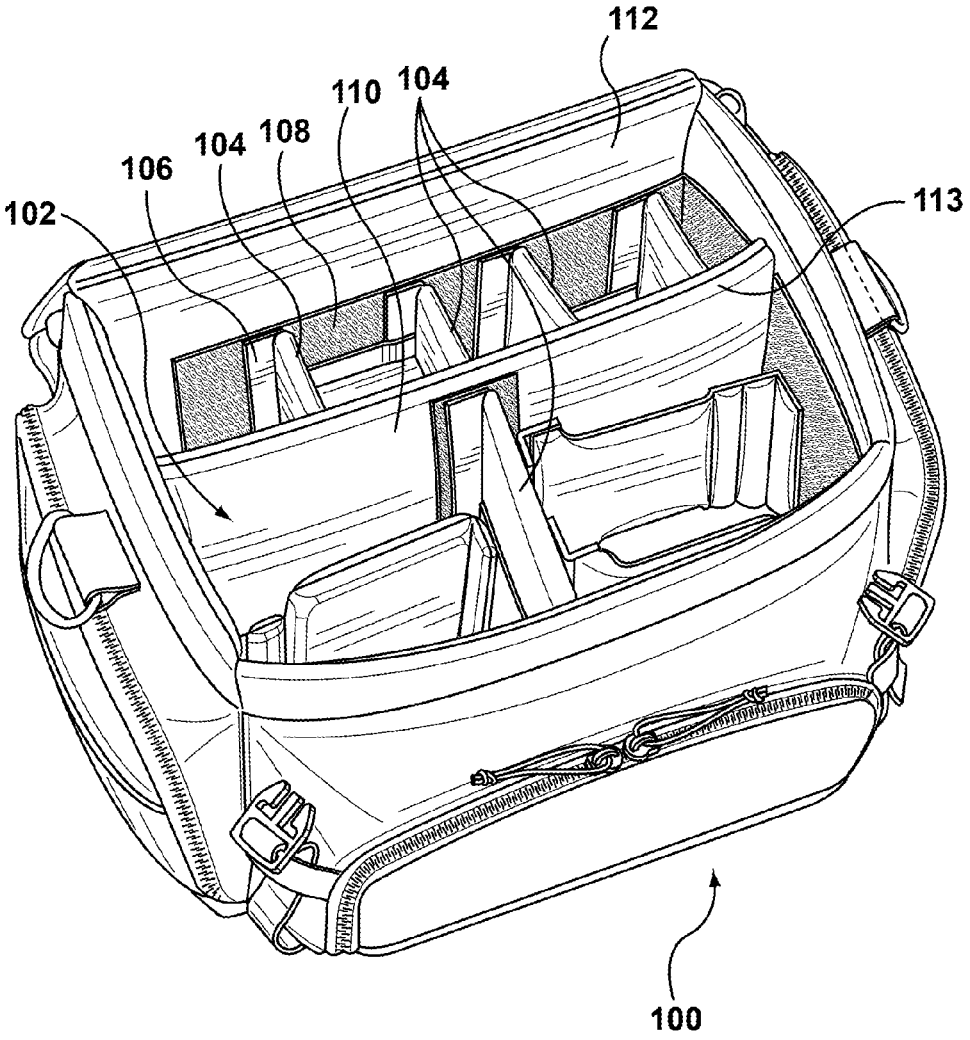
FIG. 2 (PRIOR ART)
FIG. 2 is a perspective view of the camera bag of FIG. 1 open to view the interior of the bag.
Figure 3:
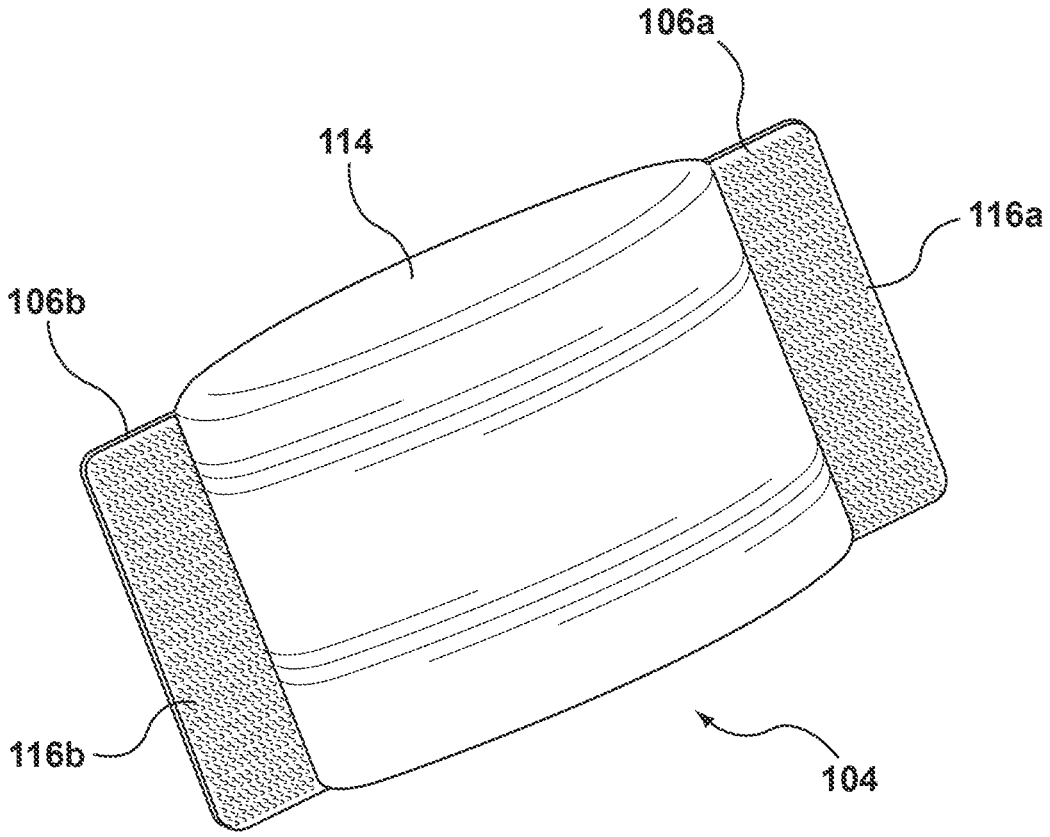
FIG. 3 (PRIOR ART)
FIG. 3 is a schematic illustration of a divider of FIG. 2.

As shown by arrow A in FIG. 9, divider 200 with attachment mechanisms 206*a*, 206*b* folded back towards each other and generally parallel to panel 201 in a first configuration is inserted unto interior compartment 312 of bag 300. In the first configuration, attachment mechanisms 206*a*, 206*b* may also be described as being generally parallel to surface 203 of divider portion 202, and as extending away from stitching 210*a*, 210*b*, respectively. Further, hook or loop material 208*a*, 208*b* of attachment mechanisms 206*a*, 206*b*, respectively, is directed away from surface 203. With attachment mechanisms 206*a*, 206*b* in the first configuration, divider 200 may be moved parallel to first and second panels 304, 306 (up and down in FIG. 10) by a user to locate divider 200 in a desired position, as shown by arrow B in FIG. 10. Because attachment mechanisms 206*a*, 206*b* are in the first configuration, the hook material 208*a*, 208*b* does not inadvertently attach itself to loop material 302, (not shown) on inner surfaces of panels 304, 306 as is common with conventional dividers, such as those shown in FIGS. 2-3. Once the user has located divider 200 at the desired location, attachment mechanisms 206*a*, 206*b* are rotated towards first and second panels 304, 306, respectively, as indicated by arrows C in FIG. 11, such that attachment mechanisms 206*a*, 206*b* are moved to a second configuration generally perpendicular to divider portion 202. Hook material 208*a*, 208*b* thus mates with loop material 302, (not shown) on inner surface of first and second panels 304, 306, respectively, to lock divider 200 at the desired location, thereby dividing interior compartment 312 into a first compartment 314 and a second compartment 316, as shown in FIG. 11. Further, as attachment mechanisms 206*a*, 206*b* are attached to the inner surface of first and second panels 304, 306, locator portions 204*a*, 204*b*, may rotate as indicated by arrows D in FIG. 11, to accommodate attachment mechanisms 206*a*, 206*b*. FIG. 11A is a schematic illustration of divider 200 in bag 300 after divider 200 has been inserted into bag 300. As can been seen attachment mechanisms 206*a*, 206*b* with hook material (not shown in FIG. 11A) are attached to corresponding loop material (not shown in FIG. 11A) on inner surfaces of panels 304, 306 of bag 300, with locator portions 204*a*, 204*b* rotated in a direction opposite attachment mechanisms 206*a*, 206*b*.

Figure 12:
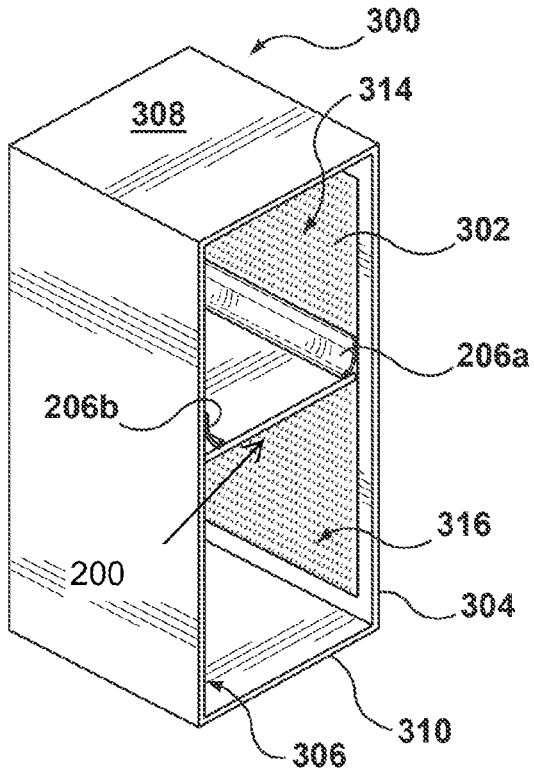
FIG. 12 is a schematic illustration of an alternative embodiment of the step of FIG. 11 of the method of FIGS. 9-11.
Figure 13:
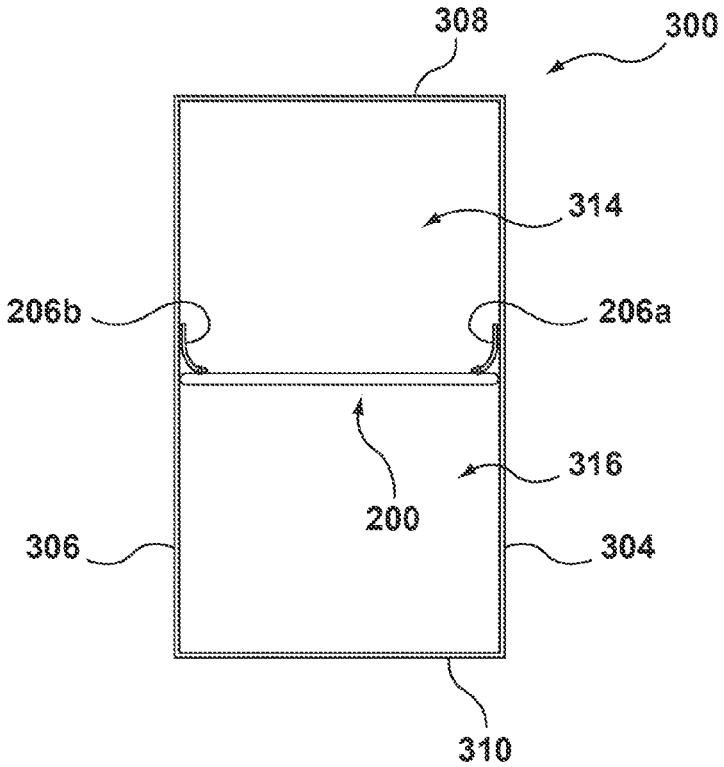
FIG. 13 is a schematic front view illustration of FIG. 12.
Figure 14:
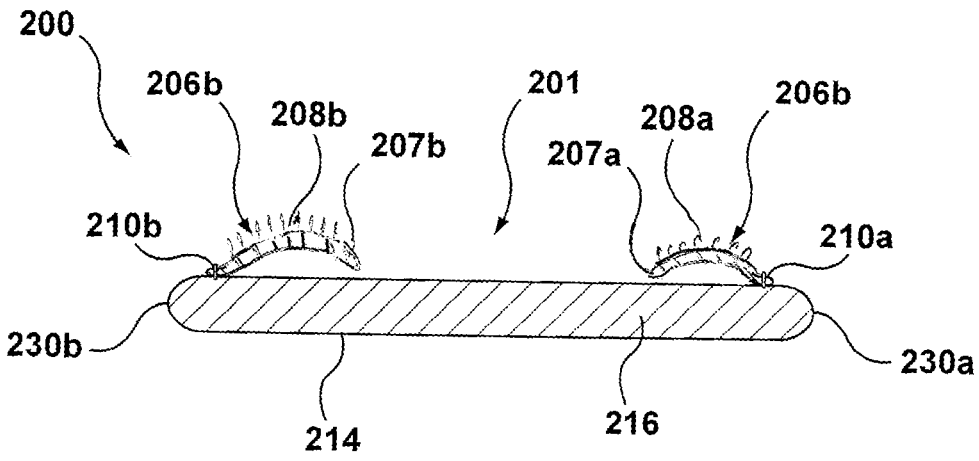
FIG. 14 is cross-sectional illustration of an embodiment of divider.
Figure 15:
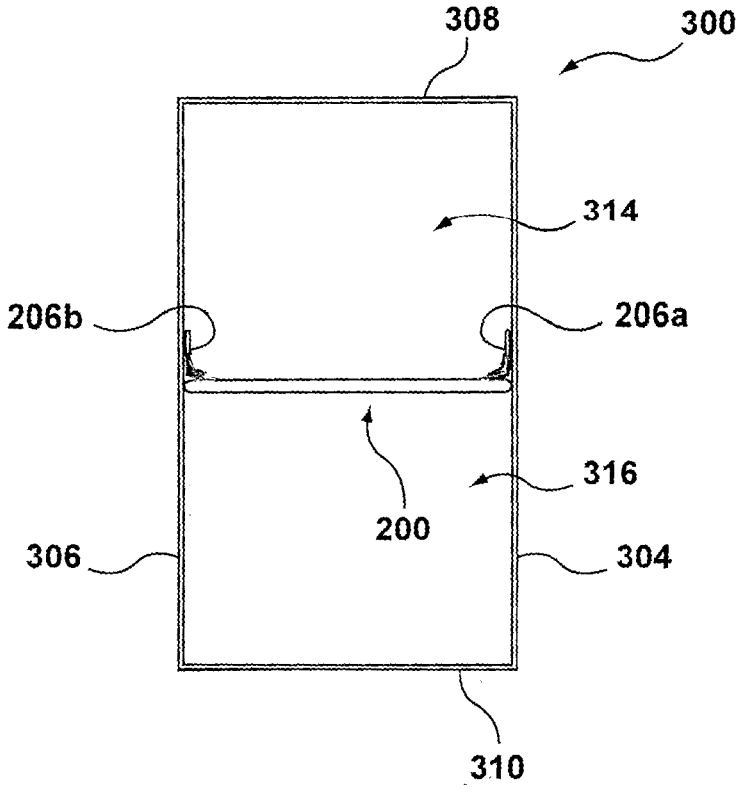
FIG. 15 is a schematic front view illustration of the divider of FIG. 14 disposed in a bag.

However, in other embodiments, as shown in FIGS. 12 and 13, attachment mechanisms 206*a*, 206*b* are sized and located such that hook material 208*a*, 206*b* may mate with loop material 302 on panel 304 and loop material (not shown) on panel 306 without locator portions 204*a*, 204*b* rotating. For example, and not by way of limitation, using the embodiment shown in FIG. 6A, attachment mechanisms 206*a*, 206*b* may extend to panels 304, 306 without portions of panel 201 rotating. This can be accomplished by the length of attachment mechanisms 206*a*, 206*b* relative to the distance from edges 230*a*, 230*b* to where attachment mechanisms 206*a*, 206*b* are attached to panel 201. Further, although FIG. 13 shows attachment mechanisms 206*a*, 206*b* at an incline, those skilled in the art would recognize that attachment mechanisms 206*a*, 206*b* may be flexible enough to extend towards panels 304, 306 parallel to panel 201 and then extend parallel to panels 304, 306. Further, in an embodiment, attachment mechanisms 206*a*, 206*b* may be pre-formed into a C-shape configuration, as shown in FIGS. 14-15, that would conform to the surface 203 of panel 201 and the inner surface of panels 304, 306 of bag 300.

Divider 200 may be relocated at desired by the user by pulling attachment mechanisms 206*a*, 206*b* away from the inner surfaces of first and second panels 304, 306, relocating divider 200 to another desired location, and re-deploying attachment mechanisms 206*a*, 206*b* as described above.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A divider for separating a compartment of a bag comprising:

a generally planar panel including a panel first edge, a panel second edge, a panel third edge, and a panel fourth edge, wherein the panel first and second edges are generally parallel to each other and the panel third and fourth edges are generally parallel to each other;

a first attachment mechanism coupled to the panel, the first attachment mechanism including a first attachment mechanism first edge and a first attachment mechanism second edge, wherein the first attachment mechanism first edge is coupled to the panel adjacent the panel first edge along a first line generally parallel to and spaced a distance from the panel first edge, wherein the first attachment mechanism includes a first configuration wherein the first attachment mechanism extends from the first attachment mechanism first edge at the first line away from the panel first edge such that the first attachment mechanism second edge is farther from the panel first edge than the first attachment mechanism first edge and the first attachment mechanism is generally parallel to the planar panel, and a second configuration wherein the first attachment mechanism is rotated about the first attachment mechanism first edge coupled at the first line such that the first attachment mechanism extends from the first line generally perpendicular to the planar panel such that the first attachment mechanism second edge is spaced from a surface of the planar panel and the first attachment mechanism is configured to attach to a first wall of the bag; and a second attachment mechanism coupled to the panel, the second attachment mechanism including a second attachment mechanism first edge and a second attachment mechanism second edge, wherein the second attachment mechanism first edge is coupled to the panel adjacent the panel second edge along a second line generally parallel to and spaced a distance from the panel second edge, wherein the second attachment mechanism includes a first configuration wherein the second attachment mechanism extends from the second attachment mechanism first edge at the second line away from the panel second edge such that the second attachment mechanism second edge is farther from the panel second edge than the second attachment mechanism first edge and the second attachment mechanism is generally parallel to the planar panel and, a second configuration wherein the second attachment mechanism is rotated about the second attachment mechanism first edge coupled at the second line such that the second attachment mechanism extends from the second line generally perpendicular to the planar panel such that the second attachment mechanism second edge is spaced from a surface of the planar panel and the second attachment mechanism is configured to attach to a second wall of the bag.

2. The divider of claim 1, wherein the first attachment mechanism comprises a flap of a hook or loop material such that in the first configuration of the first attachment mechanism the hook or loop material faces away from a first surface of the panel and in the second configuration of the first attachment mechanism the flap is rotated around the first line such that hook or loop material faces outwardly from a center of the panel and is configured to attach to a corresponding loop or hook material of the first wall of the bag.

3. The divider of claim 2, wherein the second attachment mechanism comprises a flap of a hook or loop material such that in the first configuration of the second attachment mechanism the hook or loop material faces away from a first surface of the panel and in the second configuration of the second attachment mechanism the flap is rotated around the second line such that hook or loop material faces outwardly from a center of the panel and is configured to attach to a corresponding loop or hook material of the first wall of the bag.

4. The divider of claim 1, wherein the generally planar panel includes a first locator portion disposed between the panel first edge and a center portion of the panel and a second locator portion disposed between the panel second edge and the center portion of the panel, wherein the first and second locator portions are formed unitarily with the planar panel and each is separated from the center portion of the panel by a respective stitching line generally parallel to the panel first and second edges.

5. The divider of claim 1, wherein the generally planar panel includes a first locator portion disposed between the panel first edge and a center portion of the panel and a second locator portion disposed between the panel second edge and the center portion of the panel, wherein the first and second locator portions are formed separately from the planar panel and are attached to the planar panel to form the panel first and second edges.

6. A bag comprising:

an interior compartment defined by at least a first wall, a second wall, a third wall, and a fourth wall, wherein at least the first wall and the second wall include a patch of loop or hook material;

a divider panel including a panel first edge, a panel second edge, a panel third edge, and a panel fourth edge, wherein the panel first and second edges are generally parallel to each other and the panel third and fourth edges are generally parallel to each other;

a first attachment mechanism coupled to the panel, the first attachment mechanism including a first attachment mechanism first edge and a first attachment mechanism second edge, wherein the first attachment mechanism first edge is coupled to the panel adjacent the panel first edge along a first line generally parallel to and spaced a distance from the panel first edge, wherein a first surface of the first attachment mechanism includes a hook or loop material, wherein the first attachment mechanism includes a first configuration wherein the first attachment mechanism extends from first attachment mechanism first edge at the first line away from the panel first edge and generally parallel to the divider panel and a second configuration wherein the first attachment mechanism extends from the first attachment mechanism first edge at the first line generally perpendicular to the divider panel such that the hook or loop material of the first surface engages the corresponding loop or hook of the first wall defining the interior compartment; and a second attachment mechanism coupled to the panel, the second attachment mechanism including a second attachment mechanism first edge and a second attachment mechanism second edge, wherein the second attachment mechanism is coupled to the panel adjacent the panel second edge along a second line generally parallel to and spaced a distance from the panel second edge, wherein a first surface of the second attachment mechanism includes a hook or loop material, wherein the second attachment mechanism includes a first configuration wherein the second attachment mechanism extends from the second attachment mechanism first edge at the second line away from the panel second edge and generally parallel to the divider panel and a second configuration wherein the second attachment mechanism extends from the second attachment mechanism first edge at the second line generally perpendicular to the divider panel such that the hook or loop material of the first surface of the second attachment mechanism engages the corresponding loop or hook of the second wall defining the interior compartment.

7. A divider comprising:

a generally planar panel including a panel first edge, a panel second edge, a panel third edge, and a panel fourth edge, wherein the panel first and second edges are generally parallel to each other and the panel third and fourth edges are generally parallel to each other, the planar panel also including a panel first surface and a panel second surface;

a first flap having a first flap surface, a second flap surface, a first flap first edge, and a first flap second edge, wherein the first flap surface comprises a hook or loop material, wherein the first flap first edge is coupled to the planar panel adjacent the panel first edge along a first line generally parallel to and spaced a distance from the panel first edge, wherein the first flap includes a first configuration wherein the second flap surface is in contact with the first panel surface and the first flap surface faces away from the first panel surface and a second configuration wherein the first flap is rotated about the first line such that the first flap extends from the first line generally perpendicular to the planar panel such that the first flap surface faces the first edge of the planar panel and the second flap surface faces a center of the panel; and a second flap having a third flap surface, a fourth flap surface, a second flap first edge and a second flap second edge, wherein the third flap surface comprises a hook or loop material, wherein the second flap first edge is coupled to the planar panel adjacent the panel second edge along a second line generally parallel to and spaced a distance from the panel second edge, wherein the second flap includes a first configuration wherein the fourth flap surface is in contact with the first panel surface and the third flap surface faces away from the first panel surface and a second configuration wherein the second flap is rotated about the second line such that the second flap extends from the second line generally perpendicular to the planar panel such that the third flap surface faces the second edge of the planar panel and the fourth flap surface faces a center of the panel, wherein with the first flap in the second configuration thereof and the second flap in the second configuration thereof, the second flap surface and the fourth flap surface face each other and the first flap surface and the third flap surface are configured to attach to walls of a bag.

* * * * *